United States Patent [19]

Novak

[11] Patent Number: 4,635,565

[45] Date of Patent: Jan. 13, 1987

[54] VARIABLE HEIGHT TABLE

[75] Inventor: Warren D. Novak, Chappaqua, N.Y.

[73] Assignee: Interquad, Inc., New York, N.Y.

[21] Appl. No.: 680,440

[22] Filed: Dec. 11, 1984

[51] Int. Cl.[4] ..... A47B 9/00

[52] U.S. Cl. ..... 108/147; 108/144

[58] Field of Search ..... 108/147, 144, 106, 145, 108/146, 148, 105, 20; 248/188.4, 188.2, 188.5, 316.7, 331.8, 422, 157, 404, 405; 312/312

[56] References Cited

U.S. PATENT DOCUMENTS

| | | | |
|---|---|---|---|
| 457,645 | 8/1891 | Hancock | 108/147 X |
| 908,999 | 1/1909 | Johnson | 108/144 |
| 1,178,038 | 4/1916 | Taglin | 108/147 X |
| 2,368,748 | 2/1945 | Doty | 108/147 |
| 2,614,012 | 10/1952 | Yuan | 108/144 |
| 2,890,010 | 6/1959 | Barkheimer | 108/7 |
| 3,707,930 | 1/1973 | Yindra et al. | 108/147 |
| 3,932,009 | 1/1976 | Zollinger | 108/147 X |

FOREIGN PATENT DOCUMENTS

| | | | |
|---|---|---|---|
| 522304 | 3/1931 | Fed. Rep. of Germany | 108/144 |
| 26324 | 11/1923 | France | 108/144 |
| 737286 | 10/1932 | France | 108/147 |
| 455552 | 10/1936 | United Kingdom | 108/144 |

*Primary Examiner*—William E. Lyddane
*Assistant Examiner*—José V. Chen
*Attorney, Agent, or Firm*—Pennie & Edmonds

[57] ABSTRACT

An improved power operated vertically adjustable table which has a high degree of stability in any vertical position. The table comprises a lower support cage which rests stationary on the floor and acts as the main support for the table and an upper support cage which slides vertically within the larger lower support cage. A table top is attached to the ceiling of the upper support cage. Each of the cages comprise two round disks which are horizontally positioned, one above the other. The upper disks are inter-connected by a plurality of vertically positioned support rods; and the lower disks are similarly interconnected. When the table is in the lowermost or bottom locked position, the ceiling of the lower support cage is in contact with the ceiling of the upper support cage. When the table is in the uppermost or top locked position, the ceiling of the lower support cage is in contact with the floor of the upper support cage. When the table is between these positions, a plurality of lock sleeves are slipped on to each of the rods forming the upper support cage between the ceiling of the upper and lower support cages.

11 Claims, 5 Drawing Figures

2
42
20
5
18
15
C
13
14
2
3
19
B
8
12
31
29
28
17
4
11
9
23
6
A
1

VARIABLE HEIGHT TABLE

TECHNICAL FIELD

The present invention relates to a power-operated vertically adjustable table having a high degree of stability in any vertical position.

BACKGROUND

Adjustable height tables have been developed so that a single table can be used to different purposes which require different heights. For example, an adjustable height table may be used both as a coffee table with a height of about 18 inches or as a dining table with a height of about 30 inches. The use of a single table for more than one purpose eliminates the need to have more than one table, thereby saving space and cost. Examples of such adjustable height tables are disclosed in U.S. Pat. Nos. 2,368,748, 2,614,012, 2,890,010, and 3,707,930.

Although a number of adjustable height tables have been developed, these tables do not have a high degree of stability in all vertical positions. Specifically, the table tops of these tables are prone to wobble or rock in positions other than the lowermost position.

SUMMARY OF THE INVENTION

The present invention discloses an improved power operated vertically adjustable table which has a high degree of stability in any vertical position. In a preferred embodiment, the table comprises a lower support cage which rests stationary on the floor and acts as the main support for the table, and an upper support cage which slides vertically within the larger lower support cage. A table top is attached to the ceiling of the upper support cage. Each of the cages comprises two round disks, which are horizontally positioned one above the other. The upper disks are inter-connected by a plurality of vertically positioned support rods; and the lower disks are similarly interconnected. The structures which result from the connection of the disks and rods resembled two interlocked cylindrical cages.

When the table is in the lowermost or bottom locked position, the ceiling of the lower support cage is in contact with the ceiling of the upper support cage. When the table is in the uppermost or top locked position, the ceiling of the lower support cage is in contact with the floor of the upper support cage. When the table is between these positions, a plurality of lock sleeves are slipped on to each of the rods forming the upper support cage between the ceilings of the upper and lower support cages. Since the lock sleeves can be of any length less than the vertical distance between the lower and uppermost positions of the table, a table with a high degree of stability in any vertical position can be obtained. Accordingly, at any height, wobbling or rocking of the table top is inhibited.

BRIEF DESCRIPTION OF THE DRAWINGS

These and other objects, features, elements, and advantages of the invention will be more readily apparent from the following description of the invention, in which.

DESCRIPTION OF THE PREFERRED EMBODIMENTS

Figures 1, 5:
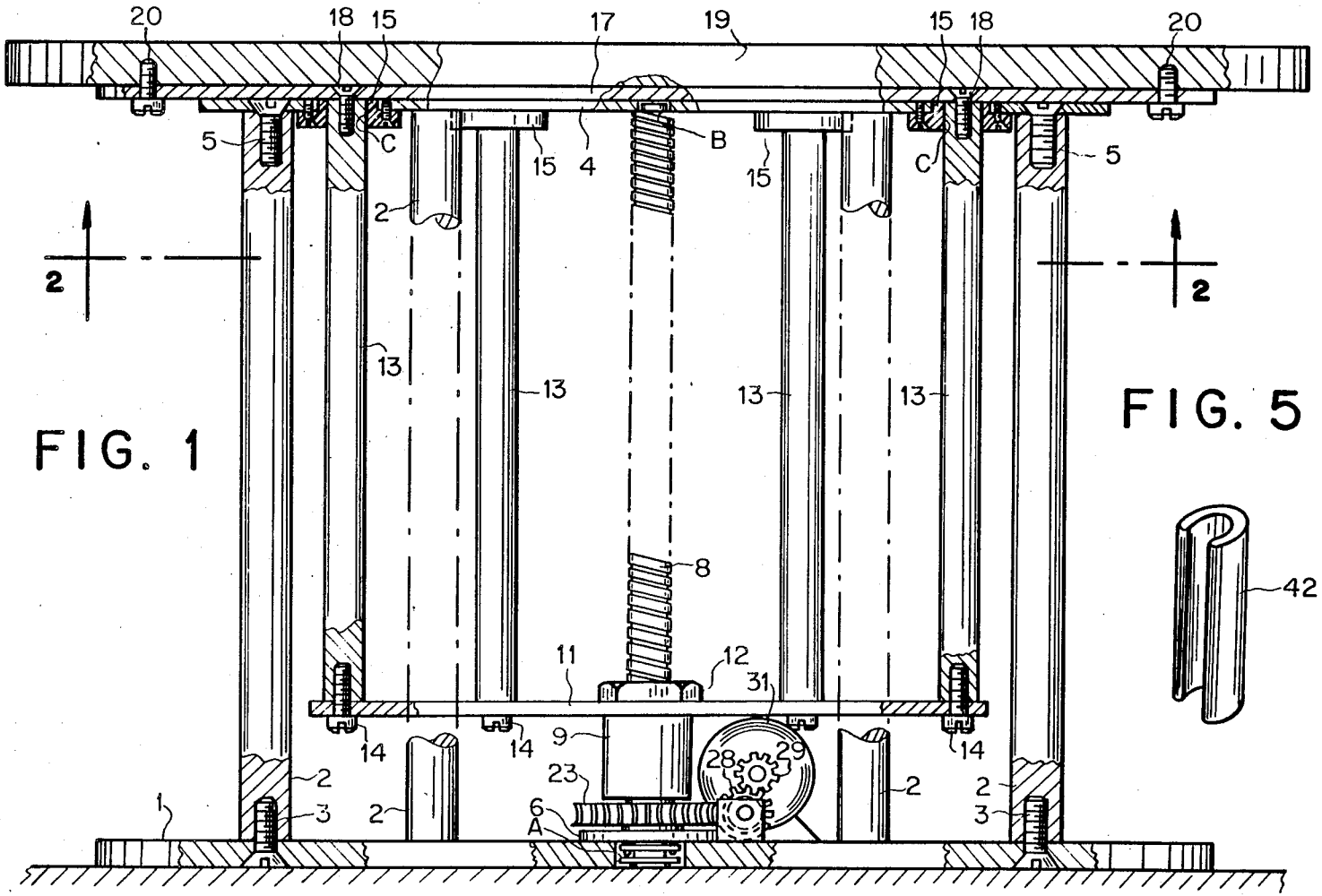
FIG. 1 is a partial sectional view of an embodiment of the adjustable height table of the present invention in the bottom locked position.
FIG. 5 is a perspective view of the lock sleeve used with the adjustable height table of the present invention.

The variable height table of the present invention comprises two slidably interlocked cages 40,41 and a power operated means for changing the vertical position of one of the cages. Each of the cages comprises two round disks which are horizontally positioned one above the other. The upper support cage 41 is comprised of upper support disk 17 and upper base disk 11 which are connected by a plurality of support rods 13. The lower support cage 40 is comprised of lower support disk 4 and lower base disk 1 which are connected by a plurality of support rods 2. In a preferred embodiment, lower support disk 4 is provided with six vertical holes C which pass completely through lower support disk 4. Each of the six upper support rods 13 slidably passes through one of the six holes C in lower support disk 4. As a result, upper support cage 41 is slidably interlocked within lower support cage 40.

A D.C. motor 31 is mounted on the lower base disk 1 of the lower cage 40 and is used to raise and lower the upper cage 41 by means of a ball bearing screw 8 which is connected to the D.C. motor 31 through a gear assembly. The ball bearing screw 8 is mounted in a ball bearing assembly which prevents the ball bearing screw 8 from moving vertically but which allows the ball bearing screw 8 to rotate freely.

When the table is in the lowermost or bottom locked position (shown in FIG. 1), the lower support disk 4 forming the ceiling of the lower support cage 40 is in contact with the upper support disk 17 forming the ceiling of the upper support cage 41. When the table is in the uppermost or top locked position (shown in FIG. 4), the lower support disk 4 forming the ceiling of the lower support cage 40 is at least in partial contact with the upper base disk 11 forming the floor of the upper support cage 41. When the table is between these positions, a plurality of lock sleeves 42 are slipped on to each of the rods 13 forming the upper support cage 41 between the upper support disk 17 forming the ceiling of the upper support cage 41 and the lower support disk 4 forming the ceiling of the lower support cage 40.

FIG. 1 is a partial sectional view of an embodiment of the adjustable height table of the present invention in the lowermost or bottom locked position. The table comprises a horizontal lower base disk 1 at the center of which is a circular hole A which passes completely through lower base disk 1. The area of lower base disk 1 is sufficiently large to stabilize the table and is illustratively circular in shape, $\frac{3}{8}$ inches thick and 26 inches in diameter, although lower base disk 1 can have numerous other shapes. Six lower support rods 2 are fastened to lower base disk 1 by six flat head screws 3 so that lower support rods 2 are vertical and perpendicular to lower base disk 1. Illustratively, lower support rods are $\frac{3}{4}$ inches in diameter and $14\frac{3}{4}$ inches long. Lower support rods 2 are fastened on their upper ends to lower support disk 4 by six flat head screws 5 so that lower support disk 4 is parallel to lower base disk 1. Illustratively, lower support disk 4 is $14\frac{3}{4}$ inches in diameter and 3/16 inches thick. The six lower support rods 2 are equally spaced at 60° intervals along a circular path, which is concentric with hole A in lower base disk 1 and is illustratively 11 inches in diameter.

Figure 4:
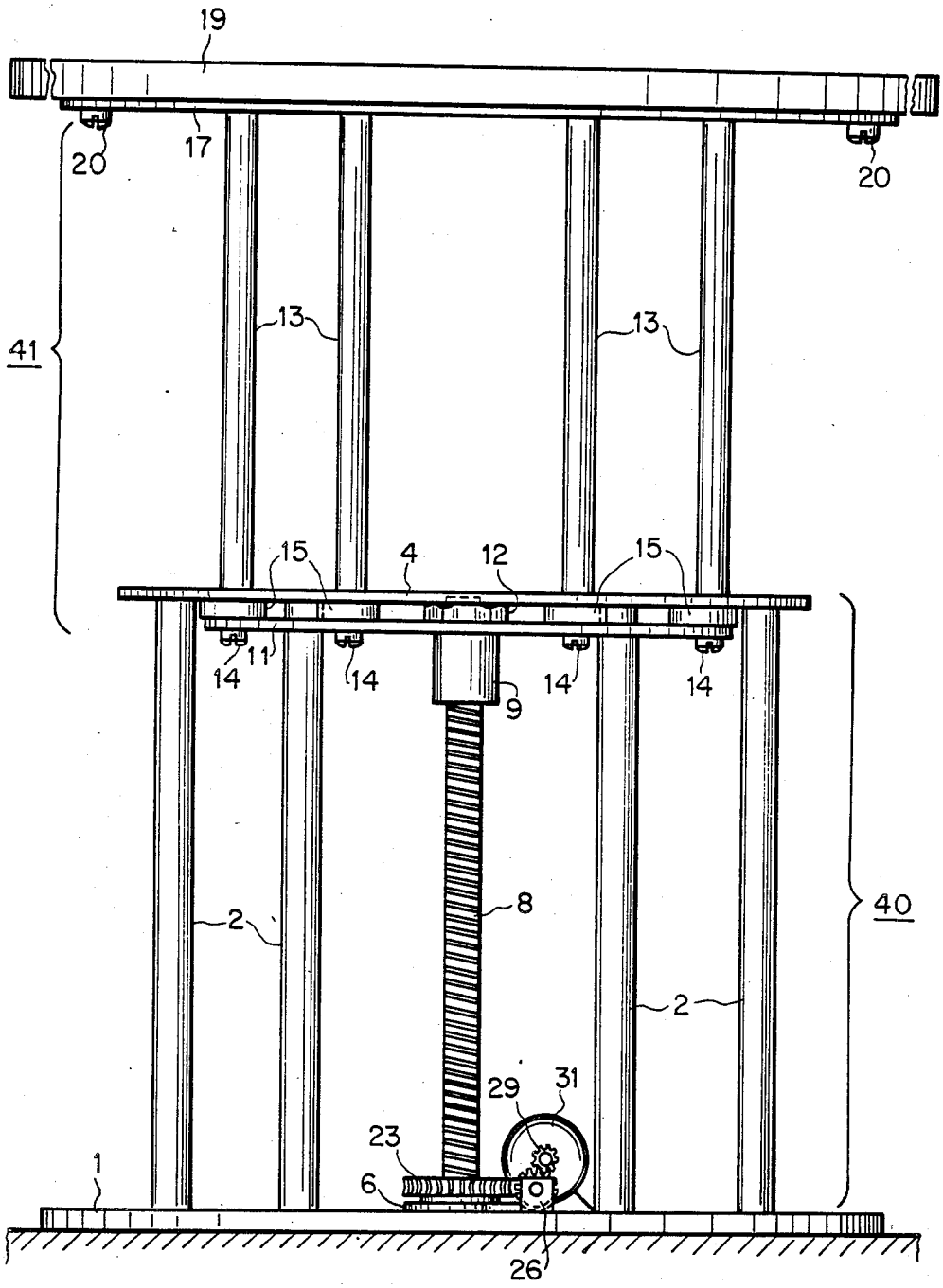
FIG. 4 is a front elevation view of an embodiment of the adjustable height table of the present invention in the top locked position.

Lower support disk 4 is preferably circular in shape and has seven holes which pass completely through lower support disk 4. One hole B is located at the center of lower support disk 4 and is concentric with the hole A at the center of base disk 1. The remaining six holes C in lower support disk 4 are equally spaced at 60° intervals along a circle which is concentric with hole B and which has a slightly smaller diameter than the circle along which lower support rods 2 are positioned. Illustratively, the circle along which holes C are spaced is 9 inches in diameter. Lower base plate 1, lower support rods 2 and lower support disk 4 form the lower support cage 40 of the adjustable table of the present invention as indicated in FIG. 4.

Donut shaped disk 6 is fastened to the upper surface of lower base disk 1 by flat head screws 7 so that the hole in donut shaped disk 6 is vertically aligned with hole A in lower base disk 1. Vertically and rotatably mounted in the holes in lower base disk 1 and donut shaped disk 6 is ball bearing screw 8. The length of ball bearing screw 8 is approximately the same as that of lower support rods 2 so that the upper end of ball bearing screw 8 is rotatably mounted in center hole B of lower support disk 4. Rotatably mounted on ball bearing screw 8 is ball bearing nut 9 which, on its upper end 10, is threaded. Resting horizontally on the threaded upper end 10 of ball bearing nut 9 is upper base disk 11. Upper base disk 11 is preferably circular in shape and has a hole at its center through which only the threaded upper end 10 of ball bearing nut 9 passes. Upper base disk 11 is fastened to the threaded upper end 10 of ball bearing nut 9 by lock ring 12 so that upper base disk 11 is parallel to lower base disk 1.

The diameter of upper base disk 11 is such that it is slightly greater than the circle along which holes C in lower support disk 4 are located but slightly less than the circle along which lower support rods 2 are positioned. Illustratively, upper base disk 11 is $10\frac{7}{8}$ inches in diameter and 3/16 inches thick.

Six upper support rods 13 are vertically fastened to upper base disk 11 by six screws 14 along a circular path at 60° intervals. Illustratively, this circular path is 9 inches in diameter. The six upper support rods 13 are fastened to upper base disk 11 so that they are perpendicular to upper base disk 11 and so that they pass through the six holes C in lower support disk 4. Illustratively, upper support rods 13 are approximately 13 inches in length and 9/16 inches in diameter.

Figure 2:
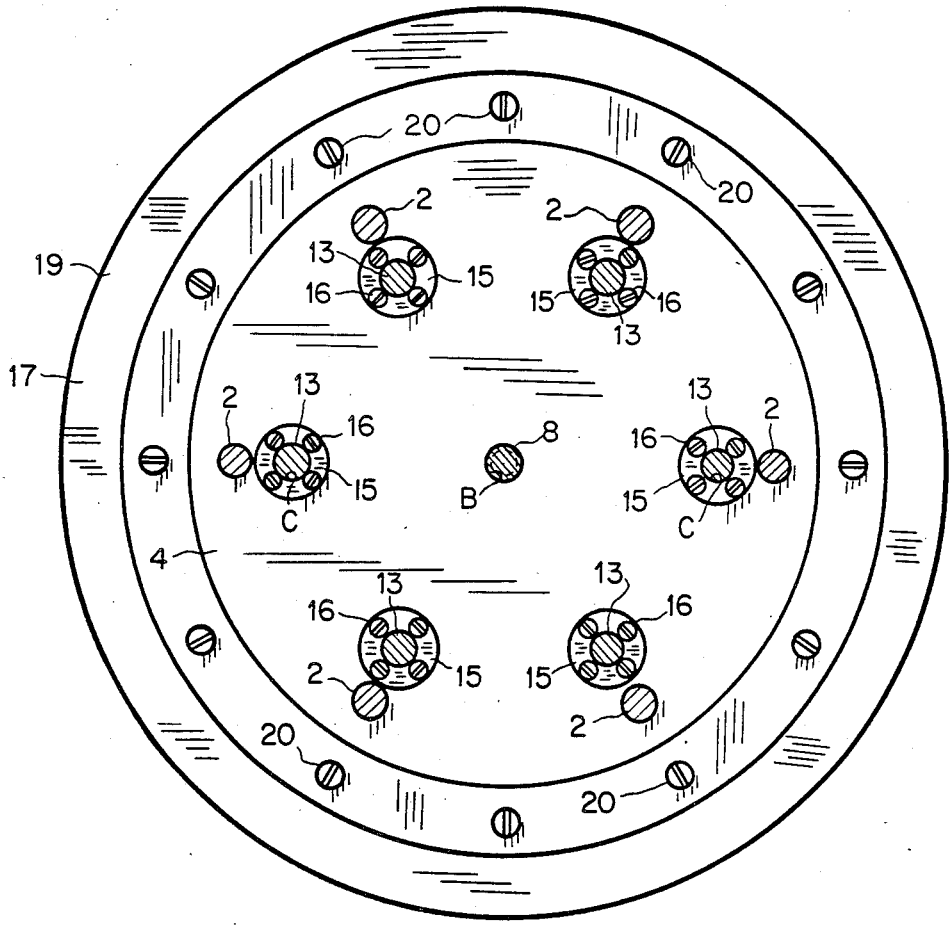
FIG. 2 is a view of the embodiment of the adjustable height table of the present invention in the bottom locked position of FIG. 1 looking upward along line II—II.

Nylon bearings 15 are mounted in each of the six holes C in lower support disk 4 by four flat head screws 16. Nylon bearings 15 each have holes through which six upper support rods 13 slidably pass. After passing through nylon bearings 15 mounted in holes C of lower support disk 4, the upper ends of upper support rods 13 are fastened to upper support disk 17 by six flat head screws 18. Table top 19 is fastened to upper support disk 17 by a plurality of screws 20. Illustratively, upper support disk 17 is 16 inches in diameter and $\frac{1}{8}$ inches thick. The size and shape of table top 19 is independent of the size and shape of upper support disk 17 and may be made of any material. Illustratively, table top 19 is circular in shape as shown in FIG. 2 which is described below. Upper base disk 11, upper support rods 13 and upper support disk 17 form the upper support cage 41 of the adjustable table of the present invention as indicated in FIG. 4.

FIG. 2 is a view of the embodiment of the adjustable height table of the present invention in the bottom locked position looking upward along the line II—II shown in FIG. 1. As can be seen in FIG. 2, the six lower support rods 2 and the six upper support rods 13 are equally spaced at 60° intervals along two concentric circles. Lower support disk 4 and upper support disk 17 are circular. In addition, ball bearing screw 8, table top 19, nylon bearings 15, flat head screws 16, and screws 20 are shown.

Figure 3:
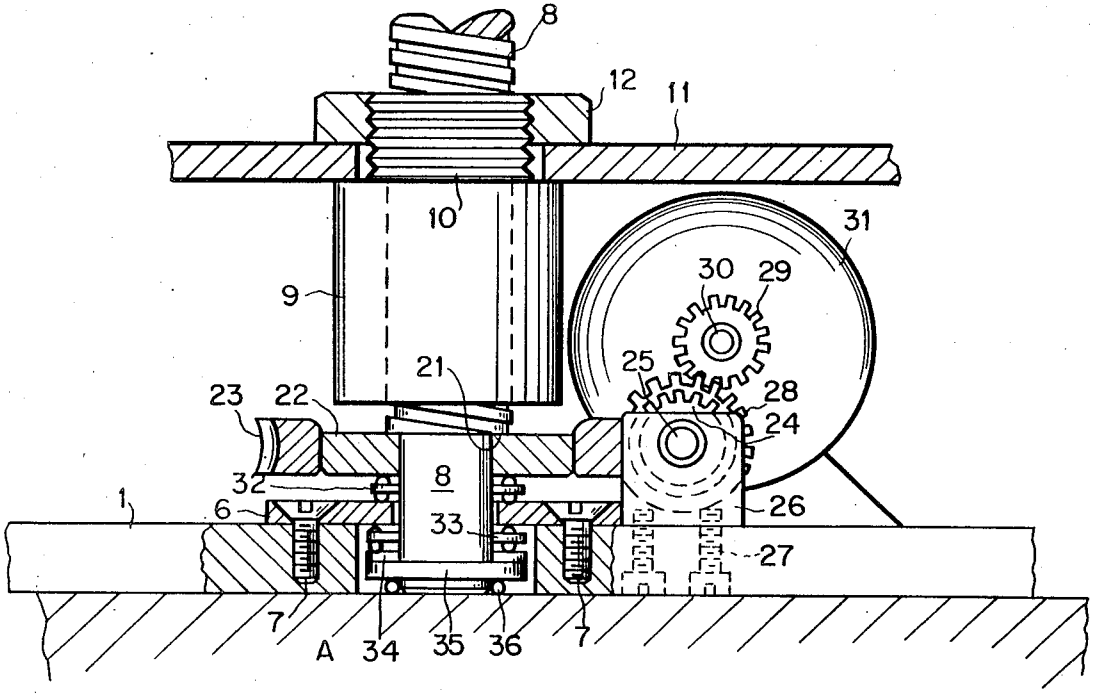
FIG. 3 is an enlarged detailed cross-sectional view of the power operated drive assembly of the present invention shown in FIG. 1.

Referring to FIG. 3 which is an enlarged detailed cross-sectional view of the power operated drive assembly of the present invention shown in FIG. 1, the bottom end of ball bearing screw 8 is machined with a shoulder and two flat ends 21 onto which is fastened worm gear disk 22. Worm gear disk 22 is positioned on ball bearing screw 8 so that worm gear disk 22 is between ball bearing nut 9 and donut shaped disk 6. Worm gear 23 is securely mounted to the perimeter of worm gear disk 22. Worm 24 engages worm gear 23 and is mounted on worm shaft 25 which is supported at both ends in ball bearing and mounting blocks 26. Mounting blocks 26 are fastened to lower base disk 1 by screws 27. Mounted on the end of worm shaft 25 is spur gear 28 which is driven by pinion gear 29 mounted on drive shaft 30 of 12-volt D.C. motor 31. D.C. motor 31 is mounted to lower base disk 1 by a plurality of screws (not shown). By selecting the appropriate gear ratios, D.C. motor 31 can provide a small amount of torque yet be capable of generating several hundred pounds of thrust to ball bearing nut 9. For example, for a 3 to 1 reduction in the spur gear chain, a 30 to 1 reduction in the worm gear chain, and an 8 to 1 reduction in the ball bearing screw/nut combination, D.C. motor 31 need only be capable of producing a maximum torque of 16 in.-oz.

The upward and downward axial thrust on ball bearing screw 8 must be bidirectionally opposed in a manner which permits ball bearing screw 8 to rotate with a minimum amount of friction. The downward force imparted by ball bearing screw 8 is opposed by upper ball bearing assembly 32 which is mounted on ball bearing screw 8 between donut shaped disk 6 and worm gear disk 22. The upward force imparted by ball bearing screw 8 is opposed by lower ball bearing assembly 33 which is mounted on ball bearing screw 8 between donut shaped disk 6 and hardened disk 34. Disk 34 is supported by spacer 35 which is held in position by snap ring 36 which is fastened to the bottom of ball bearing screw 8.

The above disclosed thrust opposing assembly permits ball bearing screw 8 to turn freely while experiencing an upward or downward thrust of up to about one ton.

The clamping force provided to ball bearing screw 8 by the power operated drive assembly, and ultimately by ball bearing nut 9, is preferrably sufficient to prevent ball bearing screw 8 from rotating when D.C. motor 31 is not operating. This clamping force thus prevents any vertical movement of upper support disk 17 and table top 19 when D.C. motor 31 is not operating. Actual working experience with the prototype of the adjustable table of this invention indicates that the tabletop is adequately stable both vertically and rotationally when the clamping force on ball bearing screw 8 is less than 200 pounds.

D.C. motor 31 is connected to a power supply (not shown) and is controlled by a remote control solid state electronic circuit (not shown) which may be mounted to the table or may be separate from the table. Illustratively, the remote control circuit comprises a single-pole double-throw rocker-type switch which has two positions: "up" and "down". The remote control circuit is designed to limit the armature current of D.C. motor 31 to a value near its allowable stall current. When the current supplied to D.C. motor 31 is less than the stall current value, ball bearing screw 8 has stopped rotating and the table has reached either the bottom locked position shown in FIG. 1 or the top locked position shown in FIG. 4. When the stall current value has not been exceeded, all power is cut off to D.C. motor 31. This type of motor controller eliminates the need for a main on-off power switch.

As can be seen from FIG. 1, which depicts the adjustable height table in its bottom locked position, upper support disk 17 is resting on the upper surface of lower support disk 4, thus preventing the table top from wobbling or rocking in the bottom locked position. In addition, ball bearing nut 9 prevents the table top from moving upward.

In operation, when D.C. motor 31 is activated by remote control circuit (not shown), drive shaft 30, pinion gear 29, spur gear 28 and worm shaft 25 rotate. The rotation of worm shaft 25 is transferred to ball bearing screw 8 by worm gear 23 and worm gear disk 22. The rotation of ball bearing screw 8 causes ball bearing nut 9 to rise along ball bearing screw 8. The rising of ball bearing nut 9 causes upper base disk 11, upper support rods 13, upper support disk 17 and table top 19 to rise. Table top 19 automatically continues to rise until it reaches the top lock position shown in FIG. 4 at which point remote control circuit (not shown) causes D.C. motor 31 to stop running.

FIG. 4 is a front elevation view of an embodiment of the adjustable height table of the present invention in the uppermost or top locked position. As can be seen from FIG. 4, upper base disk 11 is abutting the lower surface of lower support disk 4 so that upper base disk 11 is clamped tightly against the six nylon bearings 15 mounted on lower support disk 4. Ball bearing nut 9 prevents upper support cage 41 and table top 19 from moving downward, while the high compression contact of upper base disk 11 and lower support disk 4 prevents the table from wobbling or rocking, thus resulting in a stable support for the table in the top locked position. The lower surface of lower support disk 4 and/or the upper surface of upper base disk 11 are constructed so that when the table is in the top locked position there is sufficient contact between lower support disk 4 or nylon bearings 15 and upper base disk 11 to prevent rocking or wobbling. Alternatively, lower support disk 4 is machined so that nylon bearings 15 and lock ring 12 fit into recesses so that the lower surface of lower support disk 4 and the upper surface of upper base disk 11 contact one another when the table is in the top locked position.

Alternatively, the table can be stably locked in any vertical position by the use of six semi-cylindrical lock sleeves 42 as shown in FIG. 5. The internal diameter of lock sleeve 42 is approximately equal to the diameter of upper rod 13. When the table is in the top locked position shown in FIG. 4, lock sleeves 42 are preferably slipped on to the portions of upper support rods 13 that are between lower support disk 4 and upper base disk 11. The remote control circuit is then activated by the operator to cause D.C. motor 31 to lower upper support disk 17 so that lock sleeves 42 are in contact with lower support disk 4 and upper support disk 17 thereby inhibiting any downward movement of top disk 17. In addition, the use of a lock sleeve 42 on each of the six upper support rods 13 prevents table top 19 from rocking or wobbling. Illustratively, if the table is to have the height of a card table or about 26 inches, the length of lock sleeves 42 is approximately 4 inches. Alternatively, lock sleeves 42 are slipped on to the portions of upper support rods 13 that are between upper support disk 17 and lower support disk 4. However, if this method is used to obtain the height of a card table, lock sleeves 42 must be longer than the 4 inches required in the preferred method of using lock sleeves 42 as described above. Longer lock sleeves, however, are more susceptable to being bent under the compression forces applied to lock sleeves 42 by the disks. Lock sleeves 42 of different lengths can be used to obtain stable tables of various heights.

The upper and lower surfaces of lock sleeves 42 can be modified in order to increase the area of contact between lock sleeves 42 and lower support disk 4 and upper base disk 11. Alternatively, a plurality of blocks can be inserted between lower support disk 4 and upper support disk 17 near the perimeter of lower support disk 4 to stabilize the table in a position between the top and bottom locked positions. Alternatively, lock sleeves 42 are designed so that they slide onto lower support rods 2 between lower base disk 1 and upper base disk 11.

In order to obtain different sizes of table top 19, table leaves may be used or other similar devices as are known in the art.

In another embodiment, instead of upper support cage 41 sliding within lower support cage 40, upper support cage 41 surrounds lower support cage 40. The diameter of upper base disk 11 is greater than that of upper support disk 4; and the holes in the disk through which the support rods slide are located in upper base disk 11 of upper support cage 41 instead of in upper support disk 4 of lower support cage 40.

In a third embodiment, the support cages are doubly interlocked so that the support rods of each support cage slide through holes in one of the disks of the other support cage. Lower support rods 2 of lower support cage 40 pass through holes in upper base disk 11 of upper support cage 41, while upper support rods 13 pass through holes in upper support disk 4 of lower support cage 40.

While the invention has been described in conjunction with specific embodiments, it is evident that numerous alternatives, modifications, and variations will be apparent to those skilled in the art in light of the foregoing description.

For example, instead of forming lower support cage 40 and upper support cage 41 with six rods each, three, four, five or more rods may be used. In addition, the support and base disks, as well as table top 19, may have numerous other shapes, such as elliptical, rectangular, or square, instead of circular. Similarly, the support rods may be fastened to the disks along paths other than circles, such as ellipses, rectangles or squares. In addition, instead of using a D.C. motor, a reversible A.C. motor may be used.

What is claimed is:

1. A power operated vertically adjustable table comprising:

a lower support cage comprising:

a substantially horizontally positioned lower base member;

a plurality of substantially vertically positioned lower support rods fixedly attached at one end to said lower base member; and a substantially horizontally positioned lower support member located above said lower base member and fixedly attached to a second end of said plurality of lower support rods;

an upper support cage slidably attached to and interlocked with said lower support cage comprising:

a substantially horizontally positioned upper base member located beneath said lower support member and above said lower base member;

a plurality of substantially vertically positioned upper support rods fixedly attached at one end to said upper base member; and a substantially horizontally positioned upper support member located above said upper base member and said lower support member and fixedly attached to the second end of said plurality of upper support rods;

a power operated means for changing the vertical position of said upper support cage relative to said lower support cage; and at least one of said lower support member of said lower support cage and said upper base member of said upper cage being provided with a plurality of holes through each of which slidably pass one of the support rods of the other cage.

2. The power operated vertically adjustable table of claim 1 wherein said holes are located in said lower support member of said lower support cage and each of said plurality of said upper support rods of said upper support cage slidably passes through one of said plurality of holes in said lower support member.

3. The power operated vertically adjustable table of claim 2 further comprising a means for stabilizing said upper support cage in any vertical position relative to said lower support cage whereby said upper support member is prevented from rocking.

4. The power operated vertically adjustable table of claim 3 wherein said means for stabilizing comprises:

means for forcing the upper surface of said lower support member of said lower support cage to come in at least partial contact with the lower surface of said upper support member of said upper support cage when said upper support cage is in its lowermost position;

means for forcing the lower surface of said lower support member of said lower support cage to come in at least partial contact with the upper surface of said upper base member of said upper cage when said upper support cage is in its uppermost position; and means for inhibiting the movement of the upper cage when in a position between the uppermost position and the lowermost position.

5. The power operated vertically adjustable table of claim 4 wherein said means for inhibiting the movement of said upper cage comprises a plurality of semi-cylindrical lock sleeves which are slipped on the support rods of one of the cages.

6. The power operated vertically adjustable table of claim 2 wherein said power operated means for changing the vertical position of said upper support cage comprises:

a ball bearing screw assembly which is rotatably attached to said upper base member of said upper support cage, said ball bearing screw assembly being rotatably mounted on said lower base member, wherein when said ball bearing screw assembly rotates, said upper base member moves vertically; and a motor driven gear means being mounted on said lower base member of said lower support cage and driving said ball bearing screw assembly.

7. The power operated vertically adjustable table of claim 6 wherein said motor driven gear means comprises:

a worm gear attached to said ball bearing screw assembly so that rotation of said worm gear causes said ball bearing screw assembly to rotate, said worm gear being rotatably mounted on said lower base member;

a worm which engages and drives said worm gear;

a worm shaft rotatably mounted on said lower base member, said worm being fixedly mounted on said worm shaft so as to rotate therewith;

a spur gear fixedly mounted on said worm shaft so as to rotate therewith;

a pinion gear which engages and drives said spur gear, said pinion gear being rotatably mounted on said lower base member;

a motor fixedly mounted on said lower base member, said motor having a rotatable drive shaft which is driven by said motor, said pinion gear being fixedly mounted on said drive shaft so as to rotate therewith; and a controlling means which controls the operation of said motor.

8. The power operated vertically adjustable table of claim 6 wherein said ball bearing screw assembly comprises;

a ball bearing screw;

a ball bearing nut rotatably mounted on said ball bearing screw, said ball bearing nut being attached to said upper base member; and a means for rotatably mounting said ball bearing screw onto said lower base member which prevents said ball bearing screw from moving vertically and which permits said ball bearing screw to rotate with a minimum amount of friction.

9. The power operated vertically adjustable table of claim 1 wherein said holes are located in said upper base member of said upper support cage and each of said plurality of lower support rods of said lower support cage slidably passes through one of said plurality of holes in said upper base member.

10. The power operated vertically adjustable table of claim 1 wherein said holes are located in said lower support member of said lower support cage and each of said plurality of said upper support rods of said upper support cage slidably passes through one of said plurality of holes in said lower support member and wherein said holes are located in said upper base member of said upper support cage and each of said plurality of lower support rods of said lower support cage slidably passes through one of said plurality of holes in said upper base member.

11. A power operated vertically adjustable table comprising:

a lower support cage comprising:

a substantially horizontally positioned lower base member;

a plurality of substantially vertically positioned lower support rods fixedly attached at one end to said lower base member; and a substantially horizontally positioned lower support member located above said lower base member and fixedly attached to a second end of said plurality of lower support rods;

an upper support cage slidably attached to and interlocked with said lower support cage comprising:

a substantially horizontally positioned upper base member located beneath said lower support member and above said lower base member;

a plurality of substantially vertically positioned upper support rods fixedly attached at one end to said upper base member; and a substantially horizontally positioned upper support member located above said upper base member and said lower support member and fixedly attached to the second end of said plurality of upper support rods;

a power operated means for changing the vertical position of said upper support cage relative to said lower support cage; and said lower support member of said lower support cage being provided with a plurality of holes through each of which slidably pass one of the upper support rods of the upper support cage.

* * * * *